US008772187B2

(12) United States Patent
Ugbolue et al.

(10) Patent No.: US 8,772,187 B2
(45) Date of Patent: Jul. 8, 2014

(54) AUXETIC FABRIC STRUCTURES AND RELATED FABRICATION METHODS

(75) Inventors: Samuel C. Ugbolue, Taunton, MA (US); Yong K. Kim, Dartmouth, MA (US); Steven B. Warner, South Dartmouth, MA (US); Qinguo Fan, North Dartmouth, MA (US); Chen-Lu Yang, Westport, MA (US); Olena Kyzymchuk, New Bedford, MA (US)

(73) Assignee: University of Massachusetts, Boston, MA (US)

( * ) Notice: Subject to any disclaimer, the term of this patent is extended or adjusted under 35 U.S.C. 154(b) by 1201 days.

(21) Appl. No.: 12/665,166

(22) PCT Filed: Jun. 23, 2008

(86) PCT No.: PCT/US2008/007806

§ 371 (c)(1),
(2), (4) Date: Nov. 12, 2010

(87) PCT Pub. No.: WO2009/002479

PCT Pub. Date: Dec. 31, 2008

(65) Prior Publication Data

US 2011/0046715 A1 Feb. 24, 2011

Related U.S. Application Data

(60) Provisional application No. 60/936,857, filed on Jun. 21, 2007.

(51) Int. Cl.

| | |
|---|---|
| ***A61F 2/82*** | (2013.01) |
| ***D03D 19/00*** | (2006.01) |
| ***A61F 13/00*** | (2006.01) |
| ***D04B 21/06*** | (2006.01) |

(52) U.S. Cl.
USPC ..... 442/312; 442/1; 442/304; 66/195; 66/170; 602/53; 602/44; 623/1.15

(58) Field of Classification Search
USPC ..... 442/1, 304, 306, 312, 313, 314; 66/170, 66/195; 602/44, 53; 623/1.15
See application file for complete search history.

(56) References Cited

U.S. PATENT DOCUMENTS

| | | | | |
|---|---|---|---|---|
| 3,688,524 | A | 9/1972 | Peschl et al. | |
| 4,395,888 | A | 8/1983 | Wilkens | |
| 4,668,557 | A | 5/1987 | Lakes | |
| 4,703,631 | A | 11/1987 | Naumann et al. | |
| 5,331,828 | A | 7/1994 | Weis et al. | |
| 5,675,648 | A | 10/1997 | Townsend | |
| 6,477,865 | B1 | 11/2002 | Matsumoto | |
| 6,698,252 | B1 | 3/2004 | Norris et al. | |
| 6,737,371 | B1 * | 5/2004 | Planck et al. | 442/304 |
| 6,745,601 | B2 | 6/2004 | Pierelli | |
| 6,748,081 | B1 | 6/2004 | Dultz et al. | |

(Continued)

OTHER PUBLICATIONS

Ugbolue et al., "The Formation and Performance of Auxetic Textiles," Nov. 2006, National Textile Center Annual Report, Project F06-MD09, pp. 1-6.*

(Continued)

*Primary Examiner* — Cheryl Juska
(74) *Attorney, Agent, or Firm* — Fish & Richardson P.C.

(57) ABSTRACT

Auxetic fabric structures, of the sort which can be useful in conjunction with composite materials, and related methods of fabrication.

20 Claims, 5 Drawing Sheets

(56) References Cited

U.S. PATENT DOCUMENTS

| | | | |
|---|---|---|---|
| 6,776,014 | B1 | 8/2004 | Laycock et al. |
| 6,878,320 | B1 | 4/2005 | Alderson et al. |
| 7,013,681 | B1 | 3/2006 | Ternon et al. |
| 7,160,621 | B2 | 1/2007 | Chaudhari et al. |
| 7,174,749 | B2 | 2/2007 | Ternon et al. |
| 2003/0106346 | A1 | 6/2003 | Matsumoto |
| 2006/0121805 | A1 | 6/2006 | Krulic |
| 2006/0129227 | A1 | 6/2006 | Hengelmolen |
| 2007/0031667 | A1 | 2/2007 | Hook et al. |
| 2007/0093768 | A1 | 4/2007 | Roe et al. |

OTHER PUBLICATIONS

Andy Alderson et al., "Expanding materials and applications: exploiting auxetic textiles", *Technical Textiles International*, pp. 29-34 (Sep. 2005).

J.N. Grima et al., "A novel mechanism for generating auxetic behavior in reticulated foams: missing rib foam model", *Acta Materialia*, vol. 48, Issue 17, pp. 4349-4356 (Nov. 8, 2000).

Zheng Ming Huang et al., "Modeling the stress/strain behavior of a knitted fabric-reinforced elastomer composite", *Composites Science and Technology*, vol. 60, pp. 671-691 (2000).

A. A. A. Jeddi et al., "Relations between fabric structure and friction. Part III: Warp knitted fabrics", *JOTI*, vol. 97, No. 2, pp. 103-109 (2006).

K. H. Leong et al., "An Investigation of the Mechanical Performance of Weft-Knit Milano-Rib Glass/Epoxy Composites", *Composites Science and Technology*, vol. 58, pp. 239-251 (1998).

Naveen Ravirala et al., "Negative Poisson's Ratio Polyester Fibers", *Textile Research Journal*, vol. 76, No. 7, pp. 540-546 (2006).

Samuel C. Ugbolue et al., "The Formation and Performance of Auxetic Textiles", *National Textile Center Annual Report*, 6 pages (Nov. 2006).

Samuel C. Ugbolue et al., "The Formation and Performance of Auxetic Textiles", *National Textile Center Annual Report*, 10 pages (Sep. 2007).

Samuel C. Ugbolue et al., "Formation and Performance of Auxetic Textiles", *National Textile Center Annual Report*, 10 pages (Nov. 2008).

Samuel C. Ugbolue et al., "Formation and Performance of Auxetic Textiles", *National Textile Center Annual Report*, 10 pages (Oct. 2009).

Samuel C. Ugbolue et al., "Formation and Performance of Auxetic Textiles", *National Textile Center Annual Report*, 9 pages (Oct. 2010).

Samuel C. Ugbolue et al., "The Formation and Performance of Auxetic Textiles—Part I: theoretical and technical considerations", *The Journal of the Textile Institute*, vol. 101, No. 7, pp. 660-667 (Jul. 2010).

* cited by examiner

Figure 9

| | Front side | Back side | | Front side | Back side |
|---|---|---|---|---|---|
| Sample 3a #1 Nomex 200x2 den x 2 full #2 Polyester 250 den x 2 | 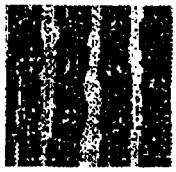 | 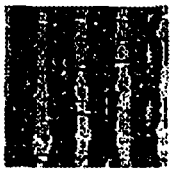 | Sample 4a #1 Nomex 200x2 den x 2 full #2 Polyester 250 den x 2 | 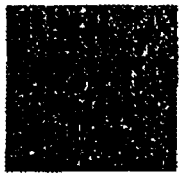 | 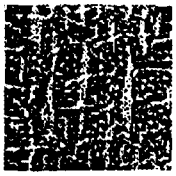 |
| Sample 3b #1 Nomex 200x2 den full #2 Polyester 250 den x 2 | 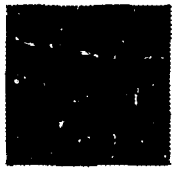 | 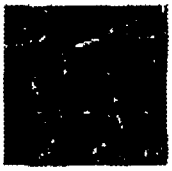 | Sample 4b #1 Nomex 200x2 den full. #2 Polyester 250 den x 2 | 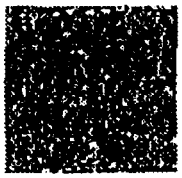 | 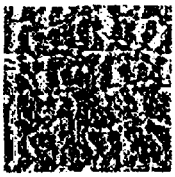 |
| Sample 3c #1 Polyester 250 den x 2 full #2 Nomex 200x2 den | 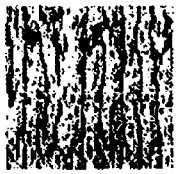 | 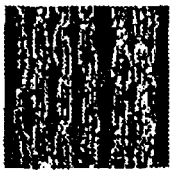 | Sample 4c #1 Polyester 250 den x 2 full #2 Nomex 200x2 den | 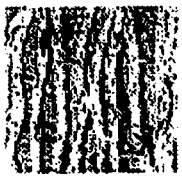 | 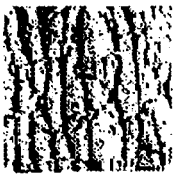 |
| Sample 3d #1 Polyester 250 den x 2 full #2 Nomex 200x2 den | 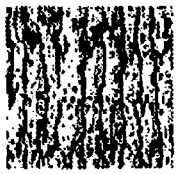 | 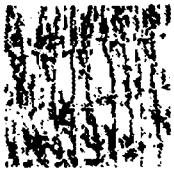 | Sample 4d #1 Polyester 250 den x 2 full #2 Nomex 200x2 den | 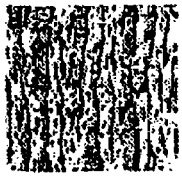 | 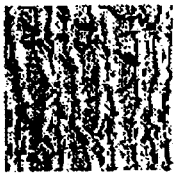 |
| | | | Sample 4e #1 Polyester 250 den x 2 full #2 Nomex 200x2 den | 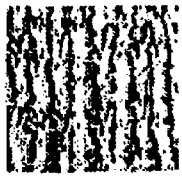 | 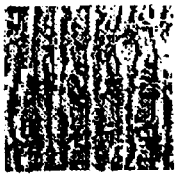 |

AUXETIC FABRIC STRUCTURES AND RELATED FABRICATION METHODS

This application claims priority benefit of application Ser. No. 60/936,857 filed on Jun. 21, 2007, the entirety of which is incorporated by reference.

The United States government has certain rights to this invention pursuant to support from the National Textile Center, NTC F06-MD09, pursuant to Grant No. S17052656706000, U.S. Department of Commerce 02-07400, to the University of Massachusetts.

BACKGROUND OF THE INVENTION

Auxetic structures can enable an article to exhibit an expansion in a lateral direction, upon subjecting the article to a longitudinal stress or strain. Conversely, auxetic structures also exhibit a contraction in the lateral direction upon subjecting such an article to longitudinal compression. Such materials are understood to exhibit a negative Poisson's ratio. Synthetic auxetic materials have been known since 1987 and are, for instance, described in the U.S. Pat. No. 4,668,557, the entirety of which is incorporated herein by reference. The '557 materials were prepared as open-celled polymeric foam and a negative Poisson's ratio was obtained as a consequence of compressive deformation of the foam. More recently, auxetic materials have been provided in the form of polymer gels, carbon filled composite laminates, metallic foams, honeycombs and microporous polymers. Recent research suggests that auxetic behavior generally results from a cooperative effect between the material's internal structure (geometry) and the deformation mechanism it undergoes when submitted to stress. (Grima, J. N; Alderson, A; Evans, K. E., Auxetic behaviour from rotating rigid units, Physica Status Solidi B:242(3), 561-576, 2005. Yang, Wei; Li, Zhong-Ming; Shi, Wei; Xie, Bang-Hu; Yang, Ming-Bo, Review on auxetic materials, Jour. Mater. Sci, 39(10), 3269-3279, 2004.) This counter-intuitive behavior imparts many beneficial effects on the material's macroscopic properties that make auxetics superior to conventional materials in many applications.

Auxetic behavior is also scale-independent. Thus, a considerable amount of research has focused on the 're-entrant honeycomb structure' which exhibits auxetic behavior when deformed through hinging at the joints or flexure of the ribs. Traditional textile technologies have been adopted for manufacturing fabric reinforcements for advanced polymer composites. Knitting in particular is well suited to the rapid manufacture of components with complex shapes due to their low resistance to deformation. The use of net-shape/near net-shape preforms is highly advantageous in terms of minimum material waste and reduced production time.

However, despite exceptional formability, knit structures are often characterized as having in-plane mechanical performance less than optimal, as compared to more conventional woven or braided fabric structures. This problem is associated with the limited utilization of fiber stiffness and strength of the severely bent fibers in the knit structure and the damage inflicted on the fibers during the knitting process. However, knitted performs for composites, built up of multiple layers of fabric, can exhibit better tensile and compressive strength, strain-to-failure, fracture toughness and impact penetration resistance, compared to laminates with only a single layer of fabric. (Leong, K. H., Ramakrishna, S., Huang, Z. M., Bibo, G. A., The potential of knitting for engineering composites, Composites: Part A, 31, 197, 2000.) Such benefits have been attributed to either increased fiber content, mechanical interlocking between neighboring fabric layers through nesting, or both.

As mentioned above, the negative Poisson's ratio effect is due to the geometric layout of the unit cell microstructure, leading to a global stiffening effect in many mechanical properties, such as in-plane indentation resistance, transverse shear modulus and bending stiffness. (Smith, C. W., Grima, J. N., and Evans, K. E., A novel mechanism for generating auxetic behaviour in reticulated foam: Missing rib foam model, Acta Materiala, 48, 4349-4356, 2000.) The highly looped fiber architecture of a knit fabric provides one approach to an auxetic fabric, in that the structure undergoes a significant amount of deformation when subjected to external forces. (Ugbolue, S. C. O., Relation between yarn and fabric properties in plain-knitted structures, Jour. Text. Inst., 74, 272, 1983.) In addition, the three-dimensional (3D) nature of knit fabrics provides some fiber bridging that facilitates opening mode fracture toughness, so improvements of up to an order of magnitude over those of glass prepreg and woven thermosets composites have been reported. Moderate improvements to the strength and stiffness of knit composites can be achieved by the incorporation of float stitches into basic architecture; weft-insert weft-knit fabrics and weft-insert warp-knit fabrics have been produced on flat-bed and warp knitting machines. 3D knit sandwich composites and 3D warp knit non-crimp composites are recent developments, but limited published information is available on their mechanical properties. Various researchers report that these composites have a higher energy absorption capacity, but exhibit lower flexural stiffness and specific compressive strength compared with several conventional sandwich polymer composites containing polymer (PMI) foam or Nomex™ cores. Overall, there remains in the art a need for an auxetic textile structure and method of fabrication, to better utilize the corresponding benefits and advantages.

SUMMARY OF THE INVENTION

In light of the foregoing, it is an object of the present invention to provide one or more auxetic fabric structures, composite articles and/or methods for their fabrication, thereby overcoming various deficiencies and shortcomings of the prior art, including those outlined above. It will be understood by those skilled in the art that one or more aspects of this invention can meet certain objectives, while one or more other aspects can meet certain other objectives. Each objective may not apply equally, in all its respects, to every aspect of this invention. As such, the following objects can be viewed in the alternative with respect to any one aspect of this invention.

It is an object of the present invention to provide one or more auxetic fabric structures as can be produced economically using available apparatus and production facilities.

It can be another object of the present invention to provide one or more auxetic fabric materials and/or composites without incorporation of any particular individual auxetic filament or yarn component of the prior art.

It can be an object of the present invention alone or in conjunction with one or more of the preceding objectives, to provide auxetic fabric structures and/or composite materials from readily available textile yarns and/or filaments, thereby overcoming any particular yarn/filament deficiency or otherwise precluding auxetic character.

Other objects, features, benefits and advantages of the present invention will be apparent from this summary and the following descriptions of certain embodiments, and will be readily apparent to those skilled in the art having knowledge of various fabric structures, composites, articles and fabrication techniques. Such objects, features, benefits and advantages will be apparent from the above as taken into conjunction with the accompanying examples, data, figures and all reasonable inferences to be drawn therefrom, alone or with consideration of the references incorporated herein.

In part, the present invention can comprise an auxetic knit fabric net structure from at least two sets of component yarns. Such a structure can comprise a plurality of first yarn components and a plurality of second yarn components disposed at an angle to the first yarn components. Such an angle can approach 0° with stretch of the first yarn components, such a fabric structure providing a Poisson's ratio less than or equal to zero. In certain embodiments, such a fabric structure provides an effective negative Poisson's ratio with a value ranging between 0 and about −5.0. In certain such embodiments, such a Poisson's ratio with a value ranging between 0 and about −1, depends on tricot course and/or chain course length.

Regardless, the first and second yarn components can comprise natural fibers, manufactured fibers and combinations thereof in continuous filament yarn and/or staple yarn forms. Without limitation, natural fiber materials can be selected from a plant origin (cotton, flax etc.) and animal origin (wool, silk etc.) Alternatively, manufactured fibers can, without limitation, be selected from viscose rayon, polyesters [polytrimethyleneterephthalate (PTT), polylactate (PLA), polyethyleneterephthalates (PET) etc.], polyamides, polyaramids, polyalkylenes, polycarbonates, polysulfones, polyethers, polyimides and combinations thereof. In any event, in certain embodiments, such a fabric structure can be without or absent an auxetic first or second yarn component. In certain such embodiments, at least one yarn component is elastic and can, optionally, comprise a multi-filament configuration.

In certain embodiments, such a net structure can be produced using at least two guide bars, with no more than one guide bar fully set. In certain such embodiments, such a structure can comprise one or more open work net structures, a non-limiting example of which is a fillet warp knitted fabric. Without limitation, as illustrated below, such a warp knitted fabric can be produced using between two and about eight guide bars partially-set, with no fully-set guide bars. In certain other embodiments, such a net structure can comprise an inlay warp knitted fabric. In certain such embodiments, as illustrated below, such a warp knitted structure can be produced using two guide bars one of which can be partially-set and the other fully-set.

Regardless of any particular net configuration, an auxetic fabric structure of this invention can comprise a single layer, tubular or multiple layers, depending upon the number of needle bars employed. Whether single or multi-layered, such an auxetic fabric structure can be present in conjunction with a composite, such a composite as can comprise an inventive auxetic fabric structure of the sort described herein coupled to or positioned on a substrate component. Various articles of manufacture can comprise such a composite. In particular, without limitation, the present invention contemplates articles for medical application, such articles including but not limited to, blood-vessel replacements, compression bandages comprising an auxetic fabric structure and a suitable substrate component.

In part, the present invention can also comprise a method of using a warp knitting technique to fabricate an auxetic warp knit net structure. Such a method can comprise providing a warp knitting system or technology comprising one or two needle beds and a plurality of guide bars; setting each guide bar with at least one yarn component; and drawing-in each such guide bar. In certain embodiments, each guide bar can be partially set. Use of one or more yarn components can, in certain such embodiments, be used to provide an auxetic net open work structure. In certain other embodiments, at least one guide bar can be fully set, with at least one other guide bar partially-set. Use of one or more yarn components can be used, in certain such embodiments, to provide an auxetic inlay warp net structure. Yarn components can be selected from those described herein or as would otherwise be understood by those skilled in the art.

BRIEF DESCRIPTION OF THE DRAWINGS

FIG. 9 illustrates examples of in-lay auxetic knit structures using guide bars #1 and #2.

DETAILED DESCRIPTION OF CERTAIN EMBODIMENTS

Figure 1:
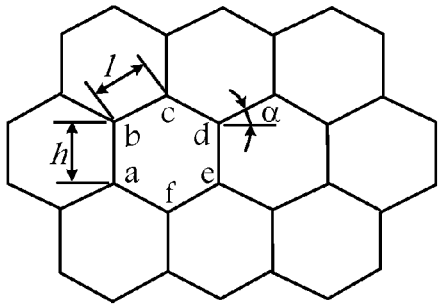
(Prior Art) Figure 1
FIG. 1 illustrates a convectional structure of the prior art.

As can relate to certain embodiments of this invention, textiles with net structure are often preferred for composites. The selection of a knit structure can be based on three technical criteria: First, the deformability of the knitted fabric, as it determines what shapes can be formed with it; as a second selection criterion, the resulting mechanical (and other) properties of the knitted fabric composite; and as a third criterion for selection of a knit structure, the hand. (Ugbolue, Samuel C., Warner, Steve B., Kim. Yong, K., Fan, Qinguo, Yang, Chen-Lu, Feng, Yani, The Formation and Performance of Auxetic Textiles, National Textile Center, *Project F*06-*MD*09, Annual Report November 2006.) As would be understood in the art, warp knitting technology provides a suitable know-how for net structures and offers major advantages in its versatility and high production speed. However, the set-up costs are considerable because the knitting machine has to be equipped with one or two needle beds and many guide bars. Nevertheless, a huge variety of knit structures can be produced and no other technology can match warp knitting technology in the production of net structures. With the right stitch construction and proper material selection, it is possible to knit square, rectangular, rhomboidal, hexagonal or almost round shape. (Whitty J. P. M., Alderson A., Myler P., Kandola B., Towards the design of sandwich panel composites with enhanced mechanical and thermal properties by variation of the in-plane Poisson's ratios. *Composites. Part: Applied Science and Manufacturing,* 2003, 34, 525-534.) See, also, warp knitting machines and related methods of fabrication, as described in U.S. Pat. Nos. 4,703,631 and 4,395,888, each of which is incorporated herein by reference in its entirety. A number of commercially-available warp knitting systems and apparatus can be used in conjunction with this invention. The auxetic fabrics herein were prepared using a warp knitting apparatus/system from Jakob Mueller, AG (model RV3MP3-630), Frick, Switzerland.

More particularly, as relates to one embodiment of this invention, fillet knitting structures are employed on a warp knitting machine with one (for single layer auxetic fabrics) or two needle beds (for tubular or 3-D double layer auxetic fabrics) using both conventional and herringbone stitches to produce auxetic structures with one or several yarn types, each of which can be with symmetrical or asymmetrical yarn inlays. The holes in the fillet knits can be formed in loop courses with return loops, and for this reason, an incomplete drawing-in of guide bars can be used to produce the net structures. Symmetrical nets can be produced when two identically-threaded guide bars overlap in balanced lapping movements in opposite directions. The threaded guides of an incomplete arrangement in each bar should pass through the same needle space at the first link in order to overlap adjacent needles otherwise both may overlap the same needle and leave the other without a thread.

For example, knitted fabric of the prior art shown in FIG. 1 is formed from two different yarns using a partial, (1-in/1-out), drawing-in of a guide bar. After knitting and allowing for some fabric relaxation under standard conditions, the warp knit structures form hexagonal nets. A typical net consists of vertical ribs ab and de from tricot courses of length h and diagonal ribs bc, cd, ef and fa form chain courses of length l. The diagonal rib is disposed at an angle α to the horizontal. The net's size depends primarily on the machine gauge and linear density of the yarn, but the rib's lengths h and l depend on the number of courses in each part of the repeating unit.

Figure 2A:
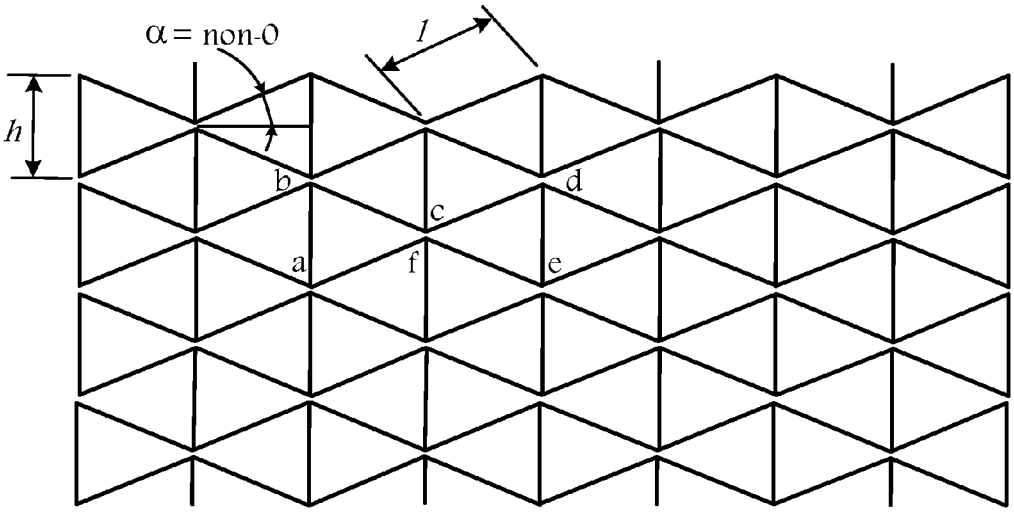
FIG. 2A provides an illustration of a representative auxetic structure, in accordance with one or more embodiments of this invention.
Figure 2B:
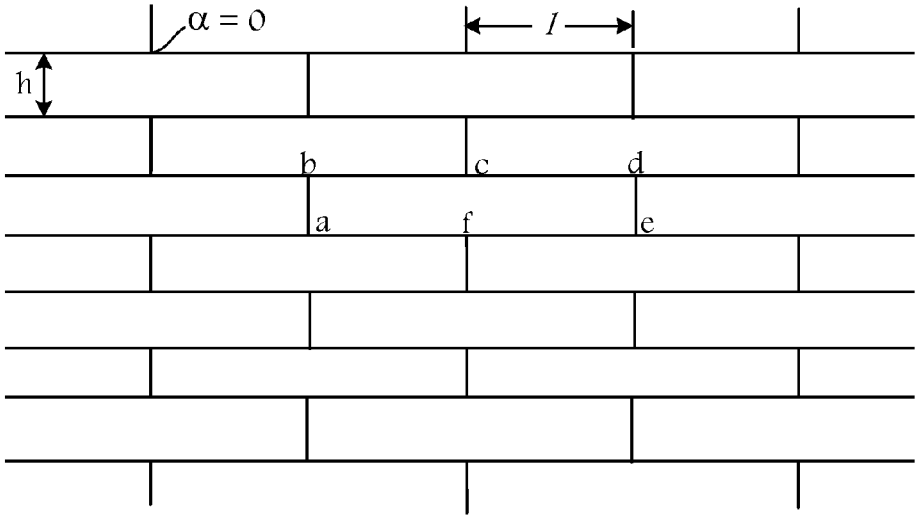
FIG. 2B illustrates the representative auxetic structure in a stretched state.
Figure 3:
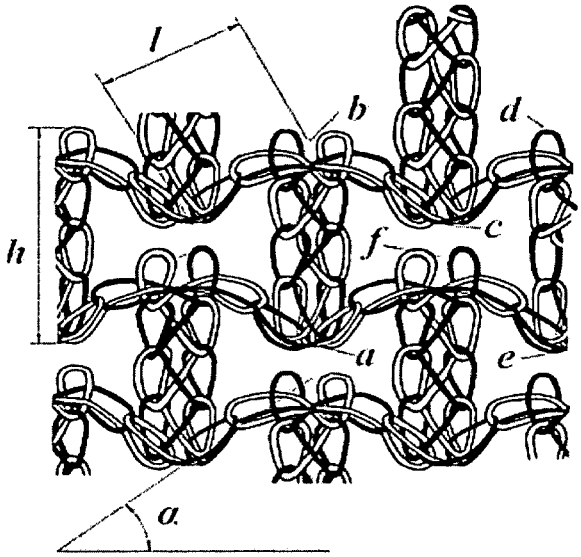
FIG. 3 illustrates another auxetic structure, in accordance with a non-limiting embodiment of this invention.

In contrast to the prior art and illustrating one embodiment of this invention, reference is made to FIG. 2. It is possible to create honeycomb fabrics with different net sizes on the same machine by changing the knitting parameters. In such a convectional structure, the wale moves past one another during fabric deformation in the wale direction causing the warp knit fabric and its varying size between vertical ribs ab and de within the net to decrease. However, disposition of the ribs in a net can be changed in order to form a functional auxetic knit structure. With reference to a substructure of FIG. 2, during stretch deformation in the wale direction, the distance between points c and f increases. The diagonal ribs bc, cd, of and fa move to the horizontal disposition, which is perpendicular to the stretch direction. In this mode, the angle α is approaching to 0° and the distance between vertical ribs ab and de increases. FIGS. 2-3 illustrate the auxetic ability of such structures. (See, also, Table 2.)

Figure 4:
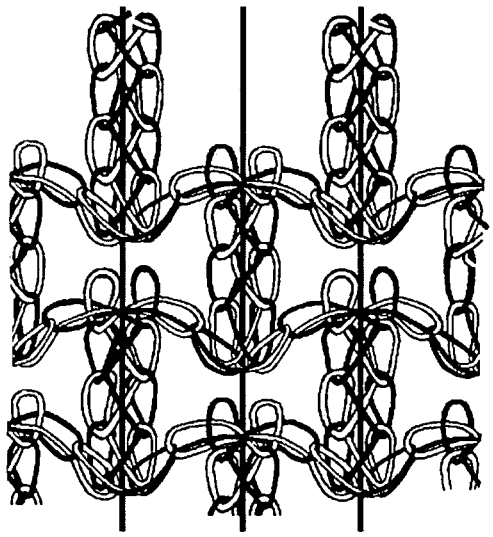
FIG. 4 illustrates an auxetic structure with inlay yarns, in accordance with one or more embodiments of this invention.

To achieve this auxetic property, a high elastic yarn is employed in the basic structure. Such a yarn should be placed between the stitch wale in the knitting direction to ensure that the fabric structure will retain necessary configuration after relaxation. The filling yarn should be laid between neighboring wales to wrap the junctures of the ground loops and provide better stability in fabrics of a structure such as that shown in FIG. 4.

In certain embodiments, to achieve such an auxetic property, an elastic yarn can be employed in the base structure. This yarn is placed between the stitch wale in the knitting direction to insure that the fabric structure retains necessary configuration after relaxation. The filling yarn is laid between neighboring wales to wrap the junctures of the ground loops and provide better stability in the fabric structure. As known in the art, three or four or more guide bars can be used to produce such knit structures.

As relates to the preceding and other embodiments hereof, the measure of the Poisson's ratio can be a characteristic of an auxetic material: Conventional materials have positive Poisson's ratio (e.g., ~+0.2 to ~+0.5), while auxetic materials have negative Poisson's ratios.

The Poisson's ratio is given by $$\nu_{yx} = -\frac{\varepsilon_x}{\varepsilon_y},$$

where $\epsilon_x$ is strain in course direction and $\epsilon_y$ is strain in wale direction.

For example, if there is initial contact between points c and f in the fabric structure of FIG. 2A, then:

$$\varepsilon_x = \frac{l - l\cos\alpha}{l\cos\alpha} = \frac{1}{\cos\alpha} - 1;$$

$$\varepsilon_y = \frac{2h - h}{h} = 1;$$

$$\nu_{yx} = -\left(\frac{1}{\cos\alpha} - 1\right) = 1 - \frac{1}{\cos\alpha}.$$

Also, if there is contact between points c and f in the fabric structure and l=h, then α=60° and $\nu_{yx}$=−1.

It is noted that the Poisson's ratio depends on angle α between the positions of a diagonal rib: before and after the stretch deformation. The value of the angle α depends on the effect of h and l, on the elastic yarn tension and on the basic yarn slippage.

With reference to FIG. 2, auxetic knit structures can be prepared from non-auxetic yarns. With reference to Table 1 and FIG. 9, various representative types of fillet warp knit fabrics and types of in-lay warp knit fabrics were produced. These fabrics were made on a 10 gauge crochet knitting machine with one needle bed. The fillet warp knit fabrics were made from 250 denier polyester yarn as ground. The 150 denier polyester sheath serving as the cover yarn for the 40 denier polyurethane core yarn provided a high elastic in-lay component. Several types of warp knit auxetic fabrics were produced based on different numbers of tricot courses (3, 5 or 7) and different numbers of chain courses (from 1 to 3), as detailed in Table 1. In order to study the influence of the yarn density, two types of yarns were used to produce the auxetic warp knit fabrics: 250 denier polyester yarn and 200 denier Nomex yarn. Also, to facilitate study of the influence of net size in the auxetic warp knit in-lay structures, three variants of drawing-in of guide bars with in-lay yarn were used, namely: one in/one out, |•|•|•, one in/two out, |••|••|••, and one in/three out, |•••|•••|•••. Digital reproductions of representative, non-limiting samples of in-lay warp knit auxetic fabrics are shown in FIG. 9.

TABLE 1

| Engineered auxetic warp knitted structures | | | | | | | |
|---|---|---|---|---|---|---|---|
| Basic structure | Number of tricot courses | 3 | 3 | 3 | 5 | 5 | 5 |

TABLE 1-continued

| Engineered auxetic warp knitted structures | | | | | | | |
|---|---|---|---|---|---|---|---|
| | Number of chain courses | 1 | 2 | 3 | 1 | 2 | 3 |
| Numbers 1-4 Guide bars | Type of yarn | Polyester | | | | | |
| | Yarn linear density | 250 den × 2 | | | | | |
| No 5 and 6 Guide bars | Type of yarn | Lycra (Spandex) covered polyester filament yarns | | | | | |
| | Yarn linear density | 40/1/150/96 | | | | | |
| Loops length, mm | #1 guide bar | 7.69 | 6.82 | 7.15 | 7.50 | 7.14 | 6.82 |
| | #3 guide bar | 6.25 | 5.88 | 6.59 | 6.02 | 6.45 | 5.94 |
| | #5 guide bar | 1.92 | 1.95 | 1.85 | 1.95 | 2.08 | 1.93 |
| | #6 guide bar | 1.85 | 1.97 | 1.85 | 1.96 | 2.41 | 1.92 |
| Number of wales per 100 mm, $N_w$ | | 32 | 28 | 20 | 32 | 32 | 33 |
| Number of courses per 100 mm, $N_c$ | | 128 | 141 | 165 | 144 | 167 | 174 |
| Stitch Density, Loops per $cm^2$ $S = (N_w N_c)/100$ | | 41 | 40 | 33 | 46 | 53 | 57 |
| Thickness, mm | | 0.36 | 0.37 | 0.33 | 0.39 | 0.43 | 0.53 |
| Basis weight, $g/m^2$ | | 223.1 | 183.7 | 165.5 | 190.4 | 214.9 | 283.6 |
| Breaking load, N (Wale Direction), | | 129.5 | 137.1 | 117.3 | 162.9 | 130.8 | 146.5 |

TABLE 1-continued

| Engineered auxetic warp knitted structures | | | | | | |
|---|---|---|---|---|---|---|
| Strain % (Wale Direction) | 278 | 298 | 331 | 264 | 279 | 274 |
| Lowest Poisson's Ratio (Wale direction) | −0.5 | −0.15 | −0.3 | −0.45 | −0.57 | −0.55 |

Figure 8:
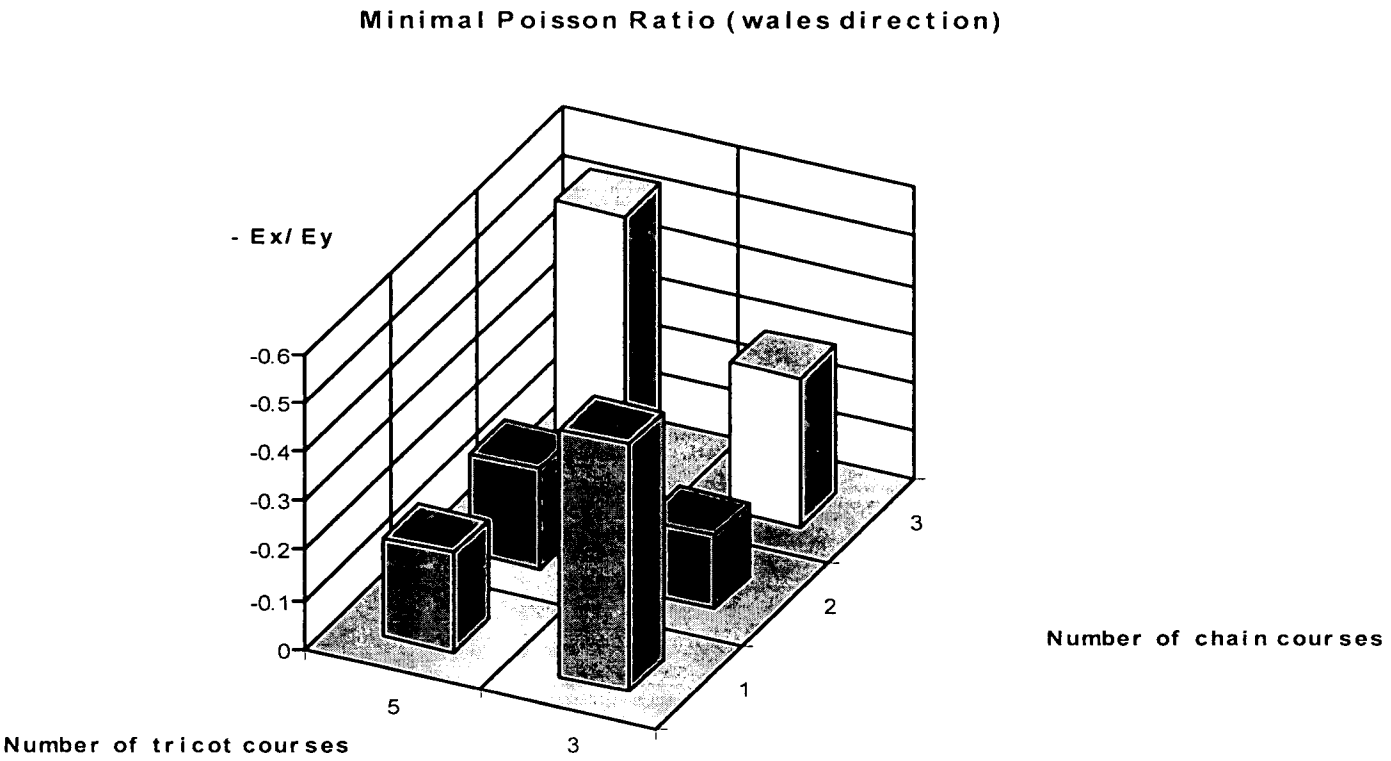
FIG. 8 graphically illustrates representative Poisson's ratio test results of auxetic warp knit structures, in accordance with this invention.

As discussed above, the measure of the Poisson's ratio is a main characteristic of the auxetic ability of materials. The conventional materials have positive Poisson's ratio whereas the auxetic materials have negative Poisson's ratio. The results of the lowest Poisson's ratio (walewise direction) given in Table 1 and shown in FIG. 8 indicate that all the fabricated fillet warp knit fabrics have negative Poisson's ratio, especially at first stage of stretching.

To further illustrate this invention, reference is made to Tables 2-3. Ten types of fillet warp knit fabrics and nine types of filling/inlay warp knit fabrics were produced, illustrating such representative embodiments of this invention. These fabrics were made on a 10-gauge crochet warp knitting machine with one needle bed. Table 2 gives an overview of the different types of fillet knitted fabrics (e.g., FIG. 2) and Table 3 gives an overview of the different types of two guide-bar open pillar/inlay warp knit fabrics (e.g., FIGS. 3-4). In order to study the effect of the yarn density, two types of yarns were used: 250 denier polyester yarn and 200 denier Nomex® yarn.

TABLE 2

| Data for the production of different types of fillet warp knitted fabrics | | | | | | | |
|---|---|---|---|---|---|---|---|
| | | Samples | | | | | |
| | | 5a | 5b | 6a | 6b | 7a | 7b |
| First guide bar | Type of yarn | Poly-ester | Nomex | Poly-ester | Nomex | Poly-ester | Nomex |
| | Yarn linear density | 250 den × 2 | 200 den | 250 den × 2 | 200 den | 250 den × 2 | 200 den |
| | Drawing-in | ·\|·\|·\|· | ·\|·\|·\|· | ·\|·\|·\|· | ·\|·\|·\|· | ·\|·\|·\|· | ·\|·\|·\|· |
| | Lapping movement | 2-3/2-1/2-3/2-1/ 1-2/2-1/1-0/1-2/ 1-0/1-2/2-1/1-2 | | 2-3/2-1/2-3/ 2-1/1-2/1-0/ 1-2/1-0/1-2/2-1 | | 2-3/2-1/2-3/2-1/ 1-0/1-2/1-0/1-2 | |
| Second guide bar | Type of yarn | Poly-ester | Nomex | Poly-ester | Nomex | Poly-ester | Nomex |
| | Yarn linear density | 250 den × 2 | 200 den | 250 den × 2 | 200 den | 250 den × 2 | 200 den |
| | Drawing-in | \|····· | \|····· | \|····· | \|····· | \|····· | \|····· |
| | Lapping movement | 1-2/2-1/1-2/2-1/ 1-2/0-1/1-0/1-2/ 1-0/1-2/1-2/1-0 | | 1-2/2-1/1-2/ 2-1/1-2/1-0/ 1-2/1-0/1-2/2-1 | | 1-2/2-1/1-2/2-1/ 1-0/1-2/1-0/1-2 | |
| Third guide bar | Type of yarn | Poly-ester | Nomex | Poly-ester | Nomex | Poly-ester | Nomex |
| | Yarn linear density | 250 den × 2 | 200 den | 250 den × 2 | 200 den | 250 den × 2 | 200 den |
| | Drawing-in | ·\|·\|·\|· | ·\|·\|·\|· | ·\|·\|·\|· | ·\|·\|·\|· | ·\|·\|·\|· | ·\|·\|·\|· |
| | Lapping movement | 1-0/1-2/1-0/1-2/ 2-1/1-2/2-3/2-1/ 2-3/2-1/1-2/2-1 | | 1-0/1-2/1-0/ 1-2/2-1/2-3/ 2-1/2-3/2-1/1-2 | | 1-0/1-2/1-0/1-2/ 2-3/2-1/2-3/2-1 | |
| Fourth guide bar | Type of yarn | Poly-ester | Nomex | Poly-ester | Nomex | Poly-ester | Nomex |
| | Yarn linear density | 250 den × 2 | 200 den | 250 den × 2 | 200 den | 250 den × 2 | 200 den |
| | Drawing-in | ·····\| | ·····\| | ·····\| | ·····\| | ·····\| | ·····\| |
| | Lapping movement | 1-0/0-1/1-0/0-1/ 1-0/0-1/1-2/1-0/ 1-2/1-0/1-0/0-1 | | 1-0/0-1/1-0/ 0-1/1-0/1-2/ 1-0/1-2/1-0/0-1 | | 1-0/0-1/1-0/0-1/ 1-2/1-0/1-2/1-0 | |
| Fifth guide bar | Type of yarn | Poly-urethane | Poly-urethane | Polyurethane | Polyurethane | Polyurethane | Polyurethane |
| | Yarn linear density | 70 den | 70 den | 70 den | 70 den | 70 den | 70 den |
| | Drawing-in | \|·\|·\|·\| | \|·\|·\|·\| | \|·\|·\|·\| | \|·\|·\|·\| | \|·\|·\|·\| | \|·\|·\|·\| |
| | Lapping movement | 1-1/1-1/1-1/1-1/ 1-1/1-1/2-2/0-0/ 2-2/1-1/1-1/1-1 | | 1-1/1-1/1-1/ 1-1/1-1/2-2/ 0-0/2-2/1-1/1-1 | | 1-1/1-1/1-1/1-1/ 2-2/0-0/2-2/1-1 | |

TABLE 2-continued

| Data for the production of different types of fillet warp knitted fabrics | | | | | | | |
|---|---|---|---|---|---|---|---|
| Sixth guide bar | Type of yarn | Poly-urethane | Poly-urethane | Poly-urethane | Poly-urethane | Polyurethane | Polyurethane |
| | Yarn linear density | 70 den | 70 den | 70 den | 70 den | 70 den | 70 den |
| | Drawing-in | ··\|·\|·\| | ··\|·\|·\| | ··\|·\|·\| | ··\|·\|·\| | ··\|·\|·\| | ··\|·\|·\| |
| | Lapping movement | 2-2/0-0/2-2/1-1/1-1/1-1/1-1/1-1/1-1/1-1 | | 2-2/0-0/2-2/1-1/1-1/1-1/1-1/1-1/1-1/1-1 | | 0-0/2-2/0-0/1-1/1-1/1-1/1-1/1-1 | |

| | | | Samples | | | |
|---|---|---|---|---|---|---|
| | | | 8a | 8b | 9a | 9b |
| | First guide bar | Type of yarn | Poly-ester | Nomex | Poly-ester | Nomex |
| | | Yarn linear density | 250 den × 2 | 200 den | 250 den × 2 | 200 den |
| | | Drawing-in | ·\|·\|·\|· | ·\|·\|·\|· | ·\|·\|·\|· | ·\|·\|·\|· |
| | | Lapping movement | 2-3/2-1/2-3/2-1/2-3/2-1/1-0/1-2/1-0/1-2/1-0/1-2 | | 2-3/2-1/2-3/2-1/2-3/2-1/1-2/1-0/1-2/1-0/1-2/1-0/1-2/2-1 | |
| | Second guide bar | Type of yarn | Poly-ester | Nomex | Poly-ester | Nomex |
| | | Yarn linear density | 250 den × 2 | 200 den | 250 den × 2 | 200 den |
| | | Drawing-in | \|····· | \|····· | \|····· | \|····· |
| | | Lapping movement | 1-2/2-1/1-2/2-1/1-2/2-1/1-0/1-2/1-0/1-2 | | 1-2/2-1/1-2/2-1/1-2/2-1/1-2/1-0/1-2/1-0/1-2/1-0/1-2/2-1 | |
| | Third guide bar | Type of yarn | Poly-ester | Nomex | Poly-ester | Nomex |
| | | Yarn linear density | 250 den × 2 | 200 den | 250 den × 2 | 200 den |
| | | Drawing-in | ·\|·\|·\|· | ·\|·\|·\|· | ·\|·\|·\|· | ·\|·\|·\|· |
| | | Lapping movement | 1-0/1-2/1-0/1-2/1-0/1-2/2-3/2-1/2-3/2-1/2-3/2-1 | | 1-0/1-2/1-0/1-2/1-0/1-2/2-1/2-3/2-1/2-3/2-1/2-3/2-1/1-2 | |
| | Fourth guide bar | Type of yarn | Poly-ester | Nomex | Poly-ester | Nomex |
| | | Yarn linear density | 250 den × 2 | 200 den | 250 den × 2 | 200 den |
| | | Drawing-in | ·····\| | ·····\| | ·····\| | ·····\| |
| | | Lapping movement | 1-0/0-1/1-0/0-1/1-0/0-1/1-2/1-0/1-2/1-0/1-2/1-0 | | 1-0/0-1/1-0/0-1/1-0/0-1/1-0/1-2/1-0/1-2/1-0/1-2/1-0/0-1 | |
| | Fifth guide bar | Type of yarn | Polyurethane | Polyurethane | Polyurethane | Polyurethane |
| | | Yarn linear density | 70 den | 70 den | 70 den | 70 den |
| | | Drawing-in | \|·\|·\|·\| | \|·\|·\|·\| | \|·\|·\|·\| | \|·\|·\|·\| |
| | | Lapping movement | 1-1/1-1/1-1/1-1/1-1/1-1/1-1/0-0/2-2/0-0/1-1/1-1 | | 1-1/1-1/1-1/1-1/1-1/1-1/1-1/0-0/2-2/0-0/1-1/1-1/1-1 | |
| | Sixth guide bar | Type of yarn | Polyurethane | Polyurethane | Polyurethane | Polyurethane |
| | | Yarn linear density | 70 den | 70 den | 70 den | 70 den |
| | | Drawing-in | ·\|·\|·\|· | ·\|·\|·\|· | ·\|·\|·\|· | ·\|·\|·\|· |
| | | Lapping movement | 1-1/2-2/0-0/2-2/1-1/1-1/1-1/1-1/1-1/1-1/1-1 | | 1-1/2-2/0-0/2-2/1-1/1-1/1-1/1-1/1-1/1-1/1-1/1-1/1-1/1-1/1-1 | |

TABLE 3

| Data for the production of different inlay warp knit fabrics | | | | | | | | | | |
|---|---|---|---|---|---|---|---|---|---|---|
| | | Samples | | | | | | | | |
| | | 3a | 3b | 3c | 3d | 4a | 4b | 4c | 4d | 4e |
| Fist guide bar | Type of yarn | Nomex | Nomex | Poly-ester | Poly-ester | Nomex | Nomex | Poly-ester | Poly-ester | Poly-ester |
| | Yarn linear density | 400 den × 2 | 400 den | 250 den × 2 | 250 den × 2 | 400 den × 2 | 400 den | 250 den × 2 | 250 den × 2 | 250 den × 2 |
| | Drawing-in | Full | Full | Full | Full | Full | Full | Full | Full | Full |
| | Lapping movement | 0-1/1-0 | 0-1/1-0 | 0-1/1-0 | 0-1/1-0 | 0-1/1-0 | 0-1/1-0 | 0-1/1-0 | 0-1/1-0 | 0-1/1-0 |

TABLE 3-continued

Data for the production of different inlay warp knit fabrics

| | | Samples | | | | | | | | |
|---|---|---|---|---|---|---|---|---|---|---|
| | | 3a | 3b | 3c | 3d | 4a | 4b | 4c | 4d | 4e |
| Second guide bar | Type of yarn | Poly-ester | Poly-ester | Nomex | Nomex | Poly-ester | Poly-ester | Nomex | Nomex | Nomex |
| | Yarn linear density | 250 den × 2 | 250 den × 2 | 400 den | 400 den | 250 den × 2 | 250 den × 2 | 400 den | 400 den | 400 den |
| | Drawing-in | \|··\|··\|·· | \|··\|··\|·· | \|··\|··\|·· | \|·\|·\|· | \|···\|···\|··· | \|···\|···\|··· | \|···\|···\|··· | \|··\|··\|·· | \|·\|·\|· |
| | Lapping movement | 0-0/1-1/1-2/4-5/5-5/6-6/3-3/4-4/4-5/2-1/2-2/3-3 | | | | | 0-0/1-1/2-3/6-7/8-8/9-9/7-6/4-4/5-5/6-7/3-2/4-4/5-5/3-2 | | | |

Figure 5:
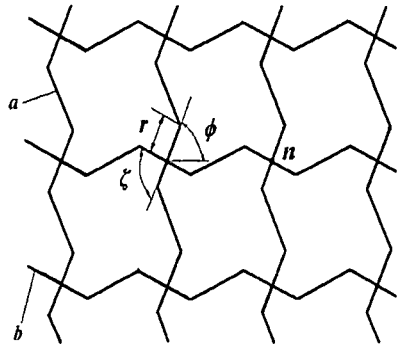
FIG. 5 provides a schematic illustration of a geometrical model for an auxetic textile structure in accordance with one or more embodiments of this invention.
Figure 6:
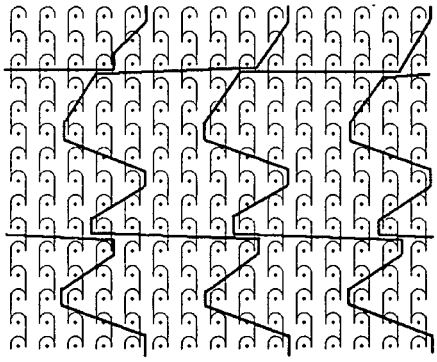
FIG. 6 illustrates lapping movements of two guide bars for producing corresponding knit auxetic fabric, in accordance with this invention.
Figure 7:
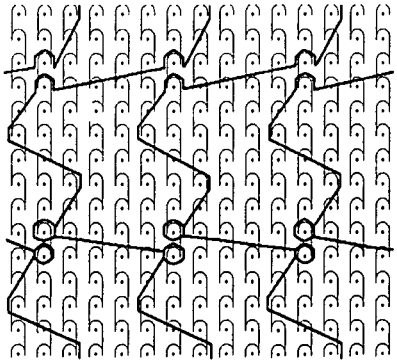
FIG. 7 illustrates lapping movement showing the creation of a corresponding carcass, in accordance with one or more embodiments of this invention.

Another general auxetic textile structure is shown in FIG. 5. The in-lay warp knit is preferred to create such an auxetic knit textile structure. It is feasible to use two types of filling yarns: a—vertical (warp) and b—horizontal (weft), in such structure, although difficulties can be encountered when producing knit structures with long weft filling yarn on a typical warp knitting machine. Several knit structures were prepared in which filling in-lay yarns are used to effect compound repeating units. In these structures, the chain can be used as a base structure, with only two guide bars to produce such knit auxetic fabrics. (See, FIG. 6.) The first guide bar which forms the base loops has a full drawing-in and the second guide bar which forms the inlay structure has a partial drawing in. For better contact to in-laying yarns in point n (FIG. 5) and facilitate the creation of the carcass from in-lay yarns, there was incorporated a design that allowed formation of loops from in-lay yarns in the same courses. (See Table 3; a stitch diagram of which is represented in FIG. 7.)

As shown, this invention can provide a cost effective way of producing auxetic fabrics from readily available textile yarns by employing geometrically engineered structures and novel design configurations. While novel designs and methods of inserting the fillet and in-lay yarns in the knit structures are illustrated, various other auxetic fabric structures are available, in accordance with the broader aspects of and considerations relating to this invention.

The present invention, without limitation to any one fabric structure or construction, can also be used in conjunction with a range of composite materials, personal protective appliances, fibrous materials, biomedical filtration materials, medical bandages. The novel fabrics of this invention offer improved shear stiffness, enhanced dimensional stability, increased plane strain fracture toughness and increased indentation resistance. In terms of cost and performance, the new auxetic textiles will be technically superior and environmentally viable, providing users with a distinct competitive advantage.

What is claimed:

1. An auxetic warp knitted fabric having a net structure, the net structure comprising:

a first chain of connected diagonal ribs, the first chain extending along a course direction, wherein adjacent diagonal ribs of the first chain extend along different diagonal directions and are connected at a valley or a peak of the first chain, and wherein each of the diagonal ribs of the first chain forms an angle α relative to the course direction;

a second chain of connected diagonal ribs, the second chain extending along the course direction, wherein adjacent diagonal ribs of the second chain extend along different diagonal directions and are connected at a valley or a peak of the second chain, and wherein each of the diagonal ribs of the second chain forms the angle α relative to the course direction; and vertical ribs extending along a wale direction perpendicular to the course direction, wherein the diagonal ribs of the first and second chains and the vertical ribs each comprises one or more yarns forming warp knit stitches that comprise loops of the yarns, wherein the loops are intermeshed and the intermeshed loops extend along a course direction or a wale direction, wherein each vertical rib connects a peak of the first chain to a valley of the second chain, and wherein at least some of the valleys of the first chain and some of the peaks of the second chain are unconnected and separated by gaps along the wale direction;

wherein in a relaxed state, the angle α is a non-zero angle, and the fabric comprises a width along the course direction and a length along the wale direction;

wherein when the fabric is stretched along either the course direction or the wale direction, the diagonal ribs of the first and second chains move towards aligning with the course direction and the angle α decreases from nonzero towards zero so that each chain becomes longer along the course direction and the width of the fabric increases, and the gaps between the unconnected valleys of the first chain and peaks of the second chain expand along the wale direction so that the length of the fabric increases in response to the stretch; and wherein the fabric has a Poisson's ratio with a value that is less than or equal to 0.

2. The auxetic warp knitted fabric of claim 1 providing an effective negative Poisson's ratio value ranging from 0 to about −5.

3. The auxetic warp knitted fabric of claim 2 wherein said Poisson's ratio value ranges from 0 to about −1.

4. The auxetic warp knitted fabric of claim 1 wherein said one or more yarns are selected from natural fibers, manufactured fibers and combinations thereof.

5. The auxetic warp knitted fabric of claim 1 wherein the fabric is free of any elastic yarns.

6. The auxetic warp knitted fabric of claim 1 further comprising an in-lay structure between at least some loops of the first or second chain, wherein the in-lay structure comprises an elastic yarn component that comprises a multi-filament configuration.

7. The auxetic warp knitted fabric of claim 1 comprising a construction selected from single layer, tubular and multi-layer constructions.

8. The auxetic warp knitted fabric of claim 7 wherein said construction is selected from single and multi-layer constructions, and said fabric is incorporated into a composite comprising said fabric coupled to a substrate component.

9. The auxetic warp knitted fabric of claim 8 wherein said composite is incorporated into one of a compression bandage, an intravascular bandage, and an intravascular stent.

10. A auxetic warp knitted fabric of claim 1 wherein the fabric is obtainable by a warp knitting process using at least three guide bars, and wherein the number of fully set guide bars is selected from 0 and 1.

11. The auxetic warp knitted fabric of claim 10 comprising a fillet warp knitted net structure.

12. The auxetic warp knitted fabric of claim 11 wherein 0 to 1 guide bars are fully-set and between 2 and about 8 guide bars are partially-set.

13. The auxetic warp knitted fabric of claim 10 comprising an inlay warp knit fabric.

14. The auxetic warp knitted fabric of claim 13 wherein the inlay warp knit fabric is formed using at least three guide bars, one said guide bar being partially-set and another guide bar being fully-set.

15. The auxetic warp knitted fabric of claim 10 wherein the fabric provides an effective negative Poisson's ratio value ranging from 0 to about −1, said Poisson's ratio value being dependent on at least one of tricot course length and chain course length.

16. The auxetic warp knitted fabric of claim 10 wherein the fabric is free of any elastic yarns.

17. A method of using a warp knitting technique to fabricate an auxetic warp knitted fabric having a net structure, said method comprising:

fully setting at least one guide bar of a plurality of guide bars of a warp knitting apparatus;

partially setting at least one guide bar of the plurality of guide bars;

forming a first chain of connected diagonal ribs, the first chain extending along a course direction, wherein adjacent diagonal ribs of the first chain extend along different diagonal directions and are connected at a valley or a peak of the first chain, and wherein each of the diagonal ribs of the first chain forms an angle $\alpha$ relative to the course direction;

a second chain of connected diagonal ribs, the second chain extending along the course direction, wherein adjacent diagonal ribs of the second chain extend along different diagonal directions and are connected at a valley or a peak of the second chain, and wherein each of the diagonal ribs of the second chain forms the angle $\alpha$ relative to the course direction; and vertical ribs extending along a wale direction perpendicular to the course direction, wherein the diagonal ribs of the first and second chains and the vertical ribs each comprises warp knit stitches comprising loops from one or more yarns, wherein the loops are intermeshed and the intermeshed loops extend along a course direction or a wale direction, wherein each vertical rib connects a peak of the first chain to a valley of the second chain, and wherein at least some of the valleys of the first chain and some of the peaks of the second chain are unconnected and separated by gaps along the wale direction;

wherein in a relaxed state, the angle $\alpha$ is a non-zero angle, and the fabric comprises a width along the course direction and a length along the wale direction;

wherein when the fabric is stretched along either the course direction or the wale direction, the diagonal ribs of the first and second chains move towards aligning with the course direction and the angle $\alpha$ decreases from nonzero towards zero so that each chain becomes longer along the course direction and the width of the fabric increases, and the gaps between the unconnected valleys of the first chain and peaks of the second chain expand along the wale direction so that the length of the fabric increases in response to the stretch; and wherein the fabric has a Poisson's ratio with a value that is less than or equal to 0.

18. The method of claim 17 wherein fabric comprises an auxetic inlay warp net structure.

19. The method of claim 18 wherein the inlay warp knit auxetic structure is fabricated using a—vertical and b—horizontal elastomeric filling yarn.

20. The method of claim 17 wherein the one or more yarns are selected from natural fibers, manufactured fibers and combinations thereof.

* * * * *